US008413362B2

(12) United States Patent
Houde-Walter

(10) Patent No.: US 8,413,362 B2
(45) Date of Patent: Apr. 9, 2013

(54) MOUNTING RAIL ASSEMBLY FOR FIREARMS

(75) Inventor: William R. Houde-Walter, Rush, NY (US)

(73) Assignee: Lasermax, Inc., Rochester, NY (US)

( * ) Notice: Subject to any disclaimer, the term of this patent is extended or adjusted under 35 U.S.C. 154(b) by 52 days.

(21) Appl. No.: 12/504,444

(22) Filed: Jul. 16, 2009

(65) Prior Publication Data

US 2011/0010979 A1 Jan. 20, 2011

(51) Int. Cl.
*F41C 27/00* (2006.01)

(52) U.S. Cl.
USPC ..... 42/84; 42/90

(58) Field of Classification Search ..... 42/84, 90
See application file for complete search history.

(56) References Cited

U.S. PATENT DOCUMENTS

| | | | | |
|---|---|---|---|---|
| 4,970,819 | A | 11/1990 | Mayhak | |
| 5,822,905 | A | 10/1998 | Teetzel | |
| 5,941,489 | A | 8/1999 | Fanelli et al. | |
| 7,562,483 | B2 * | 7/2009 | Hines | 42/90 |
| 7,627,975 | B1 * | 12/2009 | Hines | 42/84 |
| 2007/0199225 | A1 | 8/2007 | Haugen | |
| 2008/0190002 | A1 * | 8/2008 | Hines | 42/1.06 |
| 2009/0288324 | A1 * | 11/2009 | Peterson et al. | 42/75.03 |
| 2010/0083553 | A1 * | 4/2010 | Montgomery | 42/84 |
| 2010/0180485 | A1 * | 7/2010 | Cabahug et al. | 42/90 |
| 2010/0192443 | A1 * | 8/2010 | Cabahug et al. | 42/71.02 |
| 2010/0287809 | A1 * | 11/2010 | Williams | 42/90 |
| 2011/0000120 | A1 * | 1/2011 | Thompson | 42/84 |

OTHER PUBLICATIONS

The Firearm Blog website (5 pages) (http://www.thefirearmblog.com/blog/2009/06/15/goodbye-picatinny-hello-nato-accessory.

* cited by examiner

*Primary Examiner* — Bret Hayes
(74) *Attorney, Agent, or Firm* — Brian B. Shaw, Esq.; Harter Secrest & Emery LLP

(57) ABSTRACT

A mounting rail assembly is provided for firearms, wherein the assembly includes a mounting rail, an electrical input contact, an electrical output contact and an embedded conductor electrically connecting the input contact and the output contact. Control circuitry can be embedded within the mounting rail to provide for data and power transmission at the electrical contacts. The mounting rail assembly can be integrated into a firearm, or can include a receptor channel for cooperatively engaging an existing mounting rail of the firearm.

16 Claims, 5 Drawing Sheets

MOUNTING RAIL ASSEMBLY FOR FIREARMS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING"

Not applicable.

BACKGROUND OF THE INVENTION

1. Field of the Invention

The invention relates to mounting rail assemblies, and more particularly to mounting rail assemblies having a mounting rail for cooperatively mechanically and electrically engaging an accessory, wherein electrical conductors in the mounting rail assembly provide at least one of data signals or power to the connected accessory.

2. Description of Related Art

The increasing complexity of conflicts and patrol have generated a need for weapons capable of supporting various accessories, such as flashlights, infrared and night vision scopes, laser spotters, and range finders. Consequently, a wide variety of mounting systems have developed for mounting such accessories to the weapon.

These mounting systems generally include Picatinny or other rails or tracks, often using MIL-STD-1913 for standardization of the mounting systems, and are affixed to the barrel or stock of the rifle for mounting accessories thereon. A variety of designs have been suggested for such modular weapon systems, as well as differing numbers of rails which can be coupled at one time to a rifle.

As the accessories to be mounted increase in capacity and complexity, there is an increased need for powering the accessories and communicating with the accessories or between mounted accessories. Therefore, the need exists for a mounting rail assembly that can mechanically engage at least one accessory and provide at least one of power and a data signal to the accessory.

BRIEF SUMMARY OF THE INVENTION

The present mounting rail assembly provides a mounting rail body having a longitudinal axis and including a mounting rail and a receptor channel, the mounting rail extending along the longitudinal axis and having a mounting profile transverse to the longitudinal axis, the mounting profile including opposing mating surfaces for engaging mating receiving surfaces of an accessory and the receptor channel extending along the longitudinal axis and having receiving surfaces for receiving mating mounting surfaces of the firearm or an accessory, and a plurality of electrical contacts exposed to an outer surface of the mounting rail body, the electrical contacts including an electrical input contact and at least a first and a second electrical output contact.

In a further configuration, an electrical conductor is embedded in the mounting rail body, the electrical conductor electrically connecting the first and the second electrical output contacts. An electrical power source can be supported by the mounting rail.

In a further construction, the mounting rail assembly includes a mounting rail projecting from the firearm and having mounting surfaces for attaching an accessory, and a plurality of electrical contacts accessible for connection on at least one exposed surface of the mounting rail for electrically coupling the accessory to the firearm, the electrical contacts being one of recessed and flush with an adjacent surface of the mounting rail.

It is also contemplated the mounting rail assembly can include a mounting rail body having a mounting rail for engaging a firearm accessory, the mounting rail having an electrical input contact, an electrical output contact spaced from the electrical input contact and an embedded electrical conductor interconnecting the electrical input contact and the electrical output contact.

In an alternative configuration, the mounting rail assembly has a mounting rail body supporting an accessory that enhances functionality of the firearm; a receptor channel in the mounting rail body having receiving surfaces for receiving mating mounting surfaces of a mounting rail attached at least indirectly to the firearm, and electrical contacts on at least one of receiving surfaces of the receptor channel.

BRIEF DESCRIPTION OF THE SEVERAL VIEWS OF THE DRAWING(S)

DETAILED DESCRIPTION OF THE INVENTION

Figure 1:
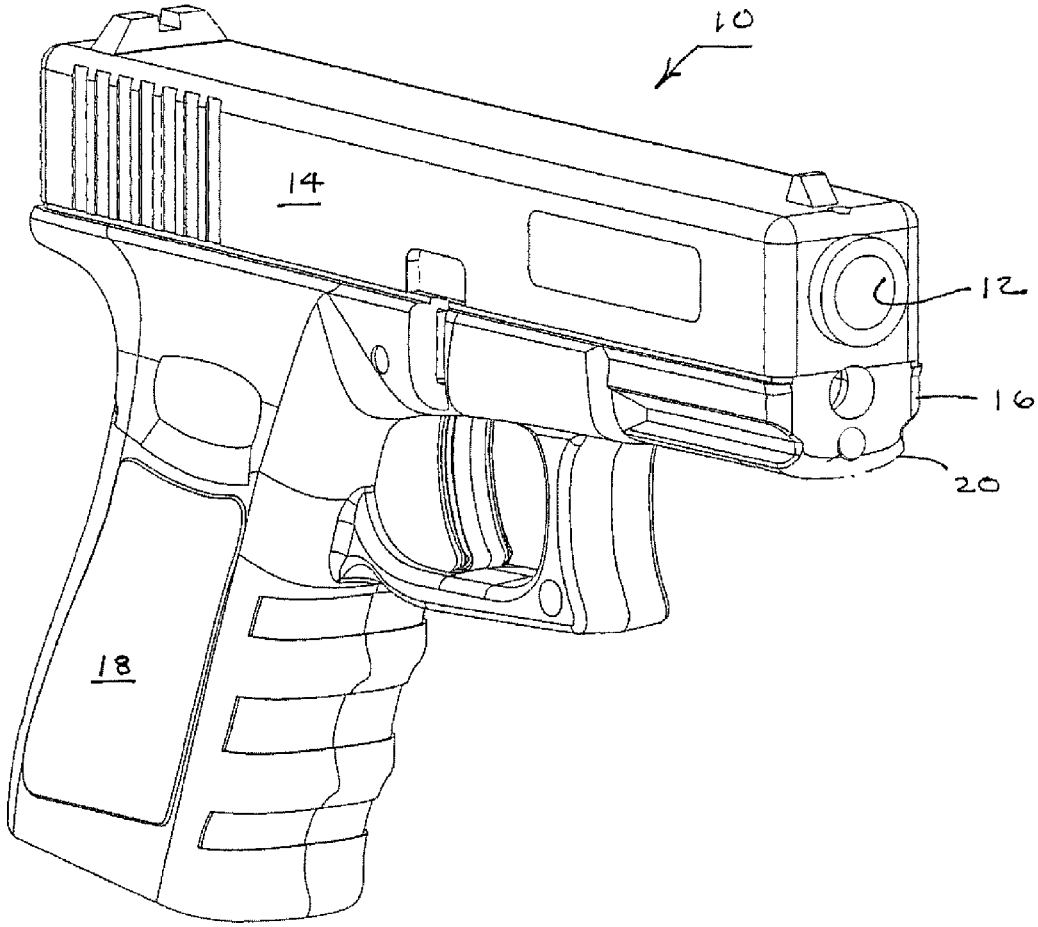
FIG. 1 is a perspective view of a pistol having a mounting rail formed integrally with the pistol.

A mounting rail assembly 20 is provided for cooperation with a firearm 10, such as in the configuration of a conventional pistol depicted in FIG. 1. The conventional pistol includes the standard features of a barrel 12, a slide 14, and a frame 16 with an integral grip 18 in addition to the mounting rail assembly 20.

By the term "firearm" it is intended to encompass any small-arm dischargeable device, any variety of hand held or portable launching devices, such as, but not limited to, hand held single operator devices, hand guns, shot guns, pistols, rifles, long guns, and can be gas-actuated, chemically fired, inertia-actuated, semiautomatic, pump action, and bolt action.

As used herein, the term "accessory" refers to items which can be attached to the mounting rail assembly 20 such as, but not limited to laser pointers, fire control devices, night vision devices, range finders, optics, thermal weapon sights, tactical lights, laser sight modules, stand alone in-line clip-on night vision systems, optical scopes, target pointer/illuminators (TPIAL) such as Mil Spec AN/PEQ-2 or AN/PEQ-4, and white light illumination devices.

The mounting rail assembly 20 can be integrally formed with the firearm 10 as seen in FIG. 1, separately formed and integrated into the firearm 10, or separately formed and cooperatively engage an existing mounting rail of the firearm as seen in FIGS. 2-6.

The mounting rail assembly 20 extends along a longitudinal axis of the firearm 10. In selected configurations, the longitudinal axis is aligned with the barrel 12 of the firearm 10.

Figure 6:
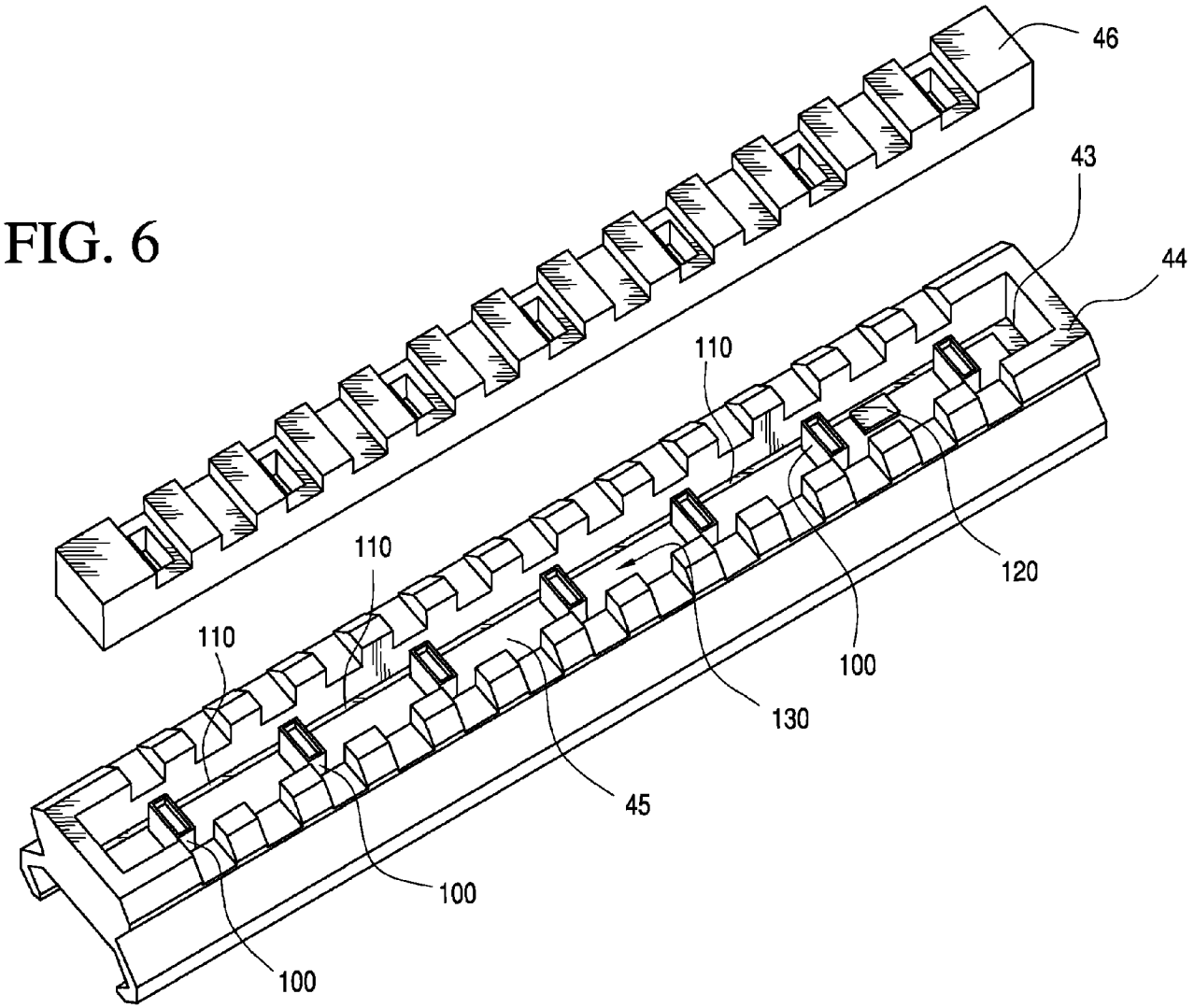
FIG. 6 is an exploded perspective view of the mounting rail assembly of FIG. 5.

In each configuration, the mounting rail assembly 20 includes mounting rail body 40 and a plurality of spaced, electrically insulated, electrical contacts 100 interconnected by an electrical conductor 110. In one configuration, the electrical contacts 100 include an electrical input contact 102, at least one electrical output contact 104 and the electrical conductor 110 (as seen in FIG. 6), electrically interconnecting the electrical input contact 102 and the electrical output contact 104, wherein the electrical input contact 102 can be connected to a power source in the mounting rail assembly 20 or can be exposed for receiving a data and/or power transmission from an external source.

The mounting rail body 40 defines a mounting rail 50, wherein the mounting rail 50 can have mounting surfaces in any of a variety of cross sections transverse to the longitudinal axis. For example, the mounting rail cross section can include, but is not limited to, a dovetail rail such as a Weaver, Picatinny, Stanag or NATO rail.

Typically, the mounting rail 50 is a dovetail rail as shown in FIGS. 2-6. The dovetail rail 50 has the conventional configuration of a Picatinny rail having a T-shaped profile. A pedestal 52 (forming the base of the T), having walls 54, 56, supports an overhanging platform 58 (forming the crossbar of the T) that has tapered sidewalls 60, 62 and 64, 66 extends along the longitudinal axis of the rail. The longitudinal axis is generally aligned with a barrel of a firearm. The tapered sidewalls 60, 62 and 64, 66, which are spaced apart along an orthogonal transverse axis of the dovetail rail, are formed as compound surfaces having opposing V-shaped profiles with respective apices 61, 65 and aligned along the transverse axis and interconnected by an end wall 68. The V-shaped profiles of the tapered sidewalls 60, 62 and 64, 66 are engageable by mating surfaces of receptors (not shown) for attaching accessories to the rail. The side walls 60, 62, 64, 66 may also be dimensioned to provide clearance for engaging the receptors.

As seen in FIGS. 2-6, the mounting rail 50 can include a plurality of recoil grooves 70. The recoil grooves 70 extend transverse to the longitudinal axis and are selected to inhibit forward and aft movement of an accessory along the longitudinal axis. The recoil grooves 70 are usually disposed at equal intervals along the longitudinal axis. Referring to FIGS. 2-6, the plurality of recoil grooves 70 define a corresponding plurality of transverse teeth 72.

In selected configurations, the mounting rail body 40 also includes a receptor channel 80 for cooperatively engaging the firearm 10, a mounting rail 50 of the firearm 16 or a mounting rail 50 on an accessory.

For example, the receptor channel 80 can have receptor surfaces defining a cross sectional profile in the shape of a dovetail rail, such as a Picatinny rail having a T-shaped profile. In such a profile, pedestal walls 82, 84 extend to tapered side walls 90, 92 and 94, 96 an interconnecting end wall 98. The tapered sidewalls 90, 92 and 94, 96, which are spaced apart along an orthogonal transverse axis of the receptor channel, are formed as compound surfaces having opposing V-shaped profiles with respective apices 91, 95 and aligned along the transverse axis. The V-shaped profiles of the tapered sidewalls are engageable by mating surfaces of a corresponding mounting rail 50 (not shown) for engaging accessories in the receptor channel 80.

Thus, it is contemplated the receptor channel 80 can have a substantially similar cross section as the mounting rail 50. Alternatively, it is understood the receptor channel 80 can have a cross section which is different than the mounting rail 50.

In the configuration of the receptor channel 80 as a dove tail rail, the receptor channel the sidewalls 90, 92 and 94, 96 define a V-shaped configuration for receiving mating sidewalls of a firearm mounting rail 50 (not shown), such as may be formed integrally with or as an attachment to a firearm. Clamps, including setscrews or other fastening structures, can be incorporated into the receptor channel 80 for securing the mounting rail assembly 20 to the mounting rail 50 received within the receptor channel.

As seen in FIGS. 2-6, the electrical contacts 10 of the mounting rail assembly 20, are open on an outer or exposed surface of the mounting rail body 40. The electrical contacts 100 can be exposed on the mounting rail 50, the receptor channel 80 or the mounting rail and the receptor channel of the mounting rail body 40. That is, the electrical contacts 100 are exposed to an outer surface of the mounting rail body 40. The electrical contacts 100 can be flush, recessed or project from an adjacent portion of the mounting rail body 40.

Further, the respective location and distribution of the electrical input contact 102 and electrical output contacts 104 can be determined by the intended operating environment or characteristics of mounting rail assembly 20. The specific number of the electrical output contacts 104 is at least partially dictated by the intended operating environment of the mounting rail assembly 20. In one configuration, the mounting rail assembly 20 includes one inlet electrical contact 102 and a plurality of outlet electrical contacts 104 as seen in FIGS. 2 and 3.

As each electrical contact 100 can receive and transmit signals, it is understood the labeling of a given electrical contact as an output contact or input contact does not limit the functionality of the respective contact.

Figure 2:
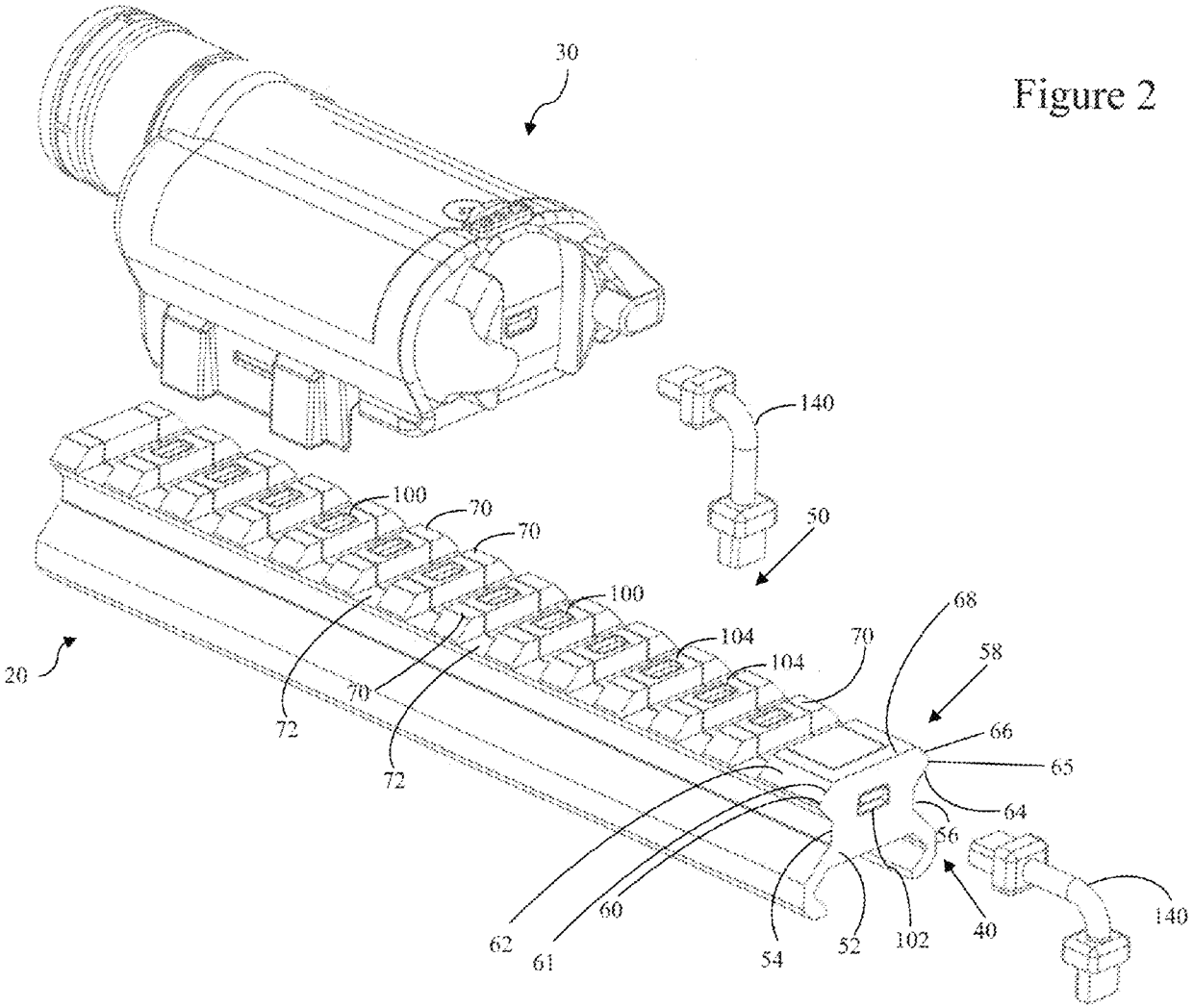
FIG. 2 is an exploded perspective view of an accessory for the firearm, the mounting rail assembly and a jumper cable.
Figure 3:
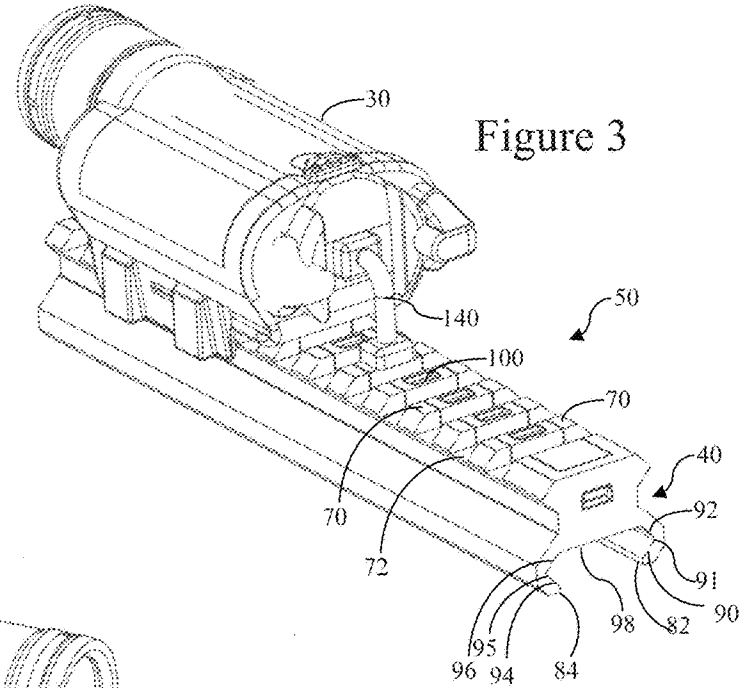
FIG. 3 is a perspective view of an accessory for the firearm engaged with the mounting rail assembly and electrically connected by the jumper cable.
Figure 4:
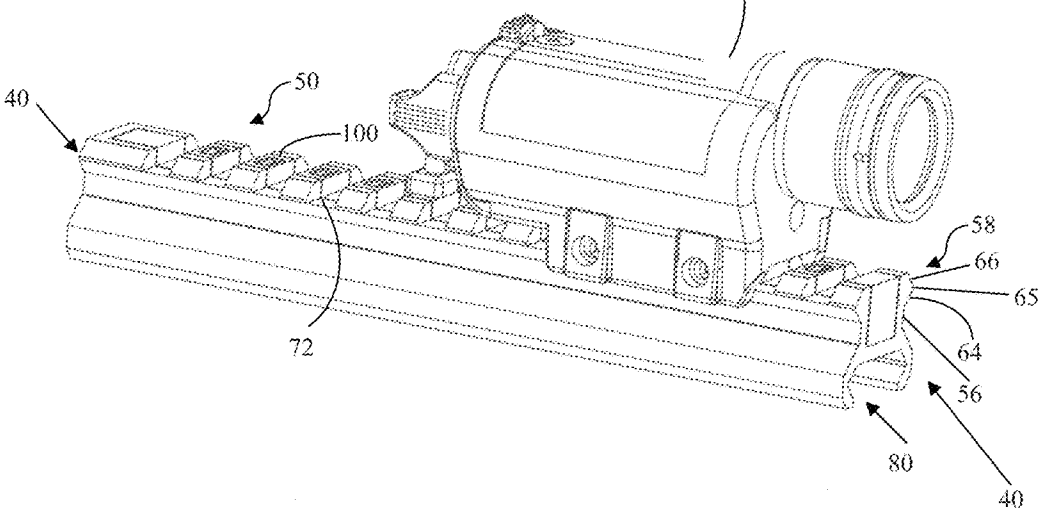
FIG. 4 is an alternative perspective view of the system of FIG. 3.
Figure 5:
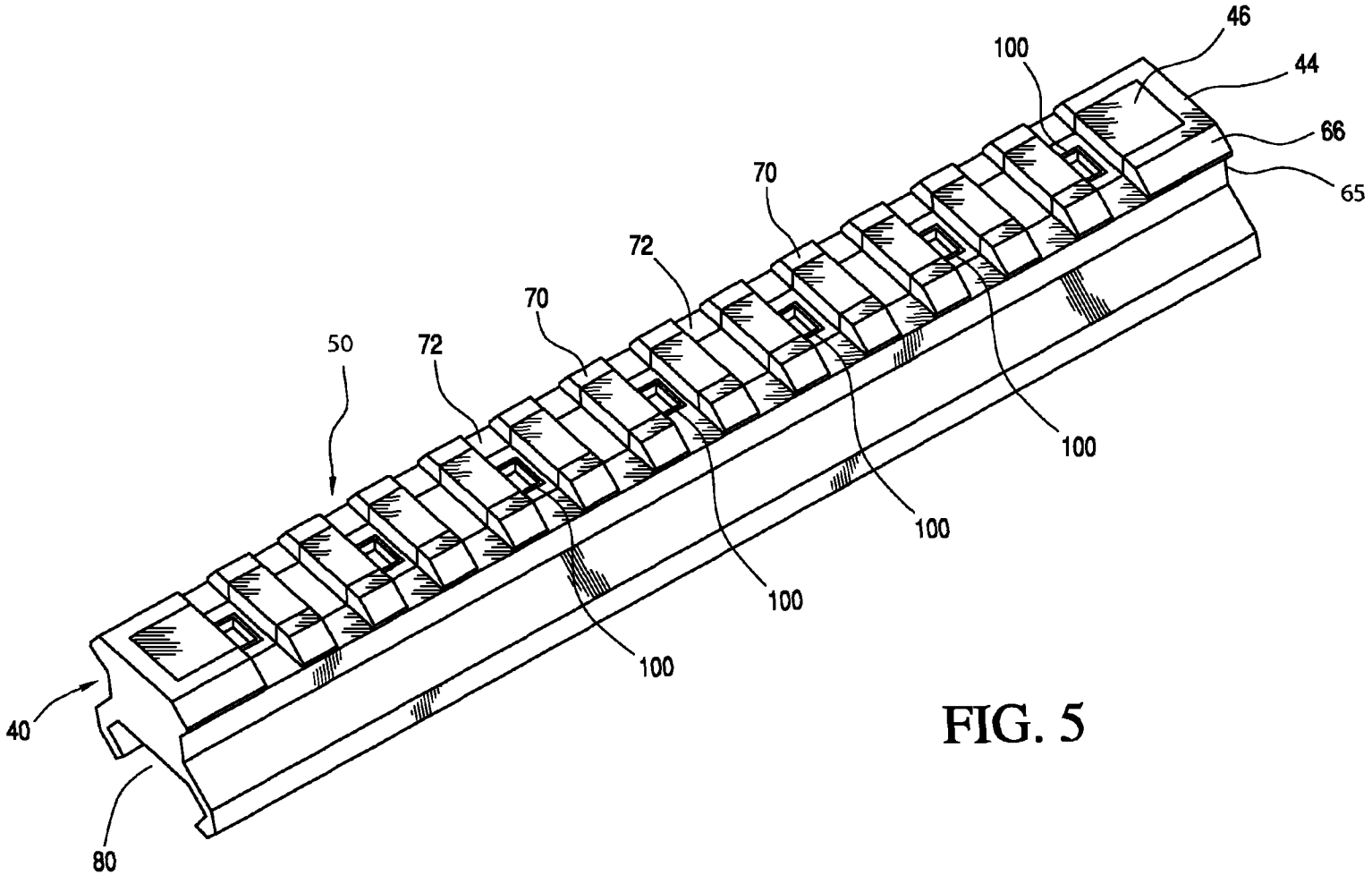
FIG. 5 is a perspective view of the mounting rail assembly.

In one configuration, as shown in FIGS. 2-4, the electrical contacts 100, such as the electrical output contacts 104 can be located within the teeth 72 defined by the recoil grooves 70 in the mounting rail 50, wherein each of a plurality of the teeth includes a corresponding one of the plurality of electrical output contacts. Alternatively, as seen in FIGS. 5 and 6, the electrical contacts 100 can be located within the recoil grooves 70, wherein each of a plurality of the recoil grooves includes an electrical contact.

The electrical contacts 100 can be in any of a variety of configurations such as USB, serial, SCSI, coaxial, HDMI. Thus, the electrical contacts 100 can provide for both power and data transmission.

The electrical contacts 100 are electrically interconnected by the electrical conductor 110. The electrical conductor 110 is selected to correspond to the given construction of the electrical contacts 100 so that the desired power and/or data can be transmitted between the electrical contacts. Thus, the electrical conductor 110 can be any of a variety of cable types including, but not limited to USB, serial, SCSI, coaxial or HDMI. In one construction, at least three electrical contacts 100 are at spaced locations on the mounting rail body 40, wherein the electrical contacts are interconnected by the embedded electrical conductor 110. The connections of the electrical contacts 100 and the electrical conductor 110 are selected so that a failure or electrical short at one electrical contact will not disable or interfere with operation of a different electrical contact.

It is contemplated that a controller, a switch, a control circuit or a printed circuit board (PCB) 120 can be electrically connected to at least one of the electrical contacts 100 such as the electrical input contact 102, the electrical output contact 104 and the electrical conductor 110. The controller 120 can be a dedicated or programmable controller for selectively controlling an accessory operably connected to one of the electrical contacts. The control can be limited to on/off functioning, or can include greater processing or cooperative integration of the connected accessories. Programming for such integration is known in the art. It is contemplated the controller or control circuit 120 can assign a unique data number to each electrical contact 100, thereby allowing for identification of the associated accessory and independent control of the respective accessory. The controller, control circuit or PCB 120 can be configured to cooperate with a remote controller, wherein the remote controller can be connected to the given firearm, or can be a separate and spaced component.

The controller, control circuit or PCB 120 or a switch can be provided operably between the electrical input contact 102 and the electrical output contacts 104 to provide for selective electrical communication between the contacts. The controller, control circuit or PCB 120 or switch can be constructed to selectively interconnect the electrical input contact 102 and at least one electrical output contact 104. It is contemplated the switch can be constructed to selectively interconnect the electrical input contact 102 and any one of the plurality of electrical output contacts 104.

In one construction, the electrical input contact 102, at least one electrical output contact 104 and the electrical conductor 110 can be integrated into a one-piece or modular electrical inlay 130. It is also contemplated the electrical inlay 130 can include the controller, control circuit of PCB 120. By incorporating these components into the electrical inlay 130, the electrical elements can be preformed in a separate process optimized for the electrical components.

The mounting rail body 40 can include a battery cavity 43 for retaining an electrical power source such as a battery, wherein the battery is electrically connected to at least one of the electrical contacts 100. In this configuration, it is contemplated that the electrical input contact 102 can be directly connected to the internal battery, as the battery provides the power for the mounting rail assembly 20. The battery cavity 43 can be sized to retain at least one button-type battery. A slide-on cover for the battery compartment can form a part of the outer surface of the mounting rail assembly 20.

The mounting rail assembly 20 can include a cover (not shown) for selectively occluding the electrical contacts. The cover can be a substantially single element sized to cover all of the electrical contacts, such as a slide moveable between a first open position and a second closed position for exposing or occluding the electrical contacts. Alternatively, a separate cover, such as a slide or hinged tab cover can be provided for each electrical contact, so that each electrical contact can be individually exposed or occluded.

As seen in FIGS. 5 and 6, the mounting rail body 40 can be formed by a frame 44 and an inset 46, wherein the electrical inlay 130 is operable retained by the frame and the electrical inlay.

Referring to FIG. 5, the frame 44 defines the receptor channel 80 and lateral portions of the mounting rail 50. The frame 44 includes a central cavity 45 sized to receive the electrical inlay 130 and the inset 46.

The inset 46 is received within the central cavity 45 to dispose a portion of the electrical inlay 130 between the frame 44 and the inset. The inset 46 can be connected to the frame 44 by any of a variety of mechanisms such as mechanical interconnection, bond, gluing or fusing.

It is also contemplated the mounting rail assembly 20 can be a molded construction, wherein the electrical inlay 130 is at least partially embedded within a molded mounting rail body 40. The mounting rail body 40 is formed of an insulative material to electrically isolate the electrical contacts 100. The mounting rail body 40 can be formed from thermoplastics, thermosets, thermoplastic elastomers or other polymer materials well known in the industry.

The mounting rail assembly 20 can electrically connect to the firearm 10 and can electrically connect to the accessory 30. The electrical connection can be made by a jumper cable or a relatively short connecting wire 140. The jumper cable 140 can include cooperating fittings as are well known in the art for operably engaging the respective electrical contact 100. It is contemplated electrical interconnection of the accessory 30 to the mounting rail 50 can be provided by direct electrical interconnection such as a socket, male-female connectors, blades or pins. It is understood these connectors or couplers can be movable between a retracted and an extended position, to allow for sliding along the mounting rail 50. For example, in one configuration, USB connectors are employed to electrically connect the mounting rail assembly 20 to at least one of the firearm and the accessory.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

The invention claimed is:

1. A mounting rail assembly mountable on a firearm, the mounting rail assembly comprising:

(a) an electrically insulating mounting rail body having a longitudinal axis and including a mounting rail and a receptor channel, the mounting rail extending along the longitudinal axis and having a mounting profile transverse to the longitudinal axis, the mounting profile having a dovetail cross section including opposing mating surfaces for engaging mating receiving surfaces of an accessory and the receptor channel extending along the longitudinal axis and having a dovetail cross section including receiving surfaces for receiving mating mounting surfaces of the firearm or an accessory;

(b) a plurality of electrically insulated electrical contacts exposed to an outer surface of the mounting rail body, the electrical contacts including an electrical input contact and at least a first and a second electrical output contact, wherein each of the electrical contacts is configured to provide power and data transmission; and (c) an electrical conductor embedded within the mounting rail body, the electrical conductor electrically connecting the plurality of electrical contacts for the transmission of power and data.

2. The mounting rail assembly of claim 1, further comprising an electrical power source supported by the mounting rail.

3. The mounting rail assembly of claim 2, wherein the electrical power source is electrically coupled the electrical conductor.

4. The mounting rail assembly of claim 1, wherein at least one of the first and the second electrical output contacts is exposed on a mounting surface of the mounting rail.

5. The mounting rail assembly of claim 1, wherein at least one of the electrical contacts is formed on at least one of the receiving surfaces of the receptor.

6. The mounting rail assembly of claim 1, wherein one of the electrical contacts is formed on a mounting surface of the mounting rail and another electrical contact is formed on at least one of the receiving surfaces of the receptor.

7. The mounting rail assembly of claim 1, wherein at least one electrical contact is formed on at least one tapered sidewall of the mounting rail.

8. The mounting rail assembly of claim 1, wherein the mounting rail includes a plurality of recoil grooves, and each of a set of the recoil grooves includes one electrical contact.

9. An electrically active mounting rail assembly of a firearm for attaching an accessory, the mounting rail assembly comprising:

(a) a mounting rail projecting from the firearm and having mounting surfaces for attaching an accessory;

(b) a plurality of electrical contacts accessible for connection on at least one exposed surface of the mounting rail for electrically coupling the accessory to the firearm, the electrical contacts being one of recessed and flush with an adjacent surface of the mounting rail;

(c) a first accessory and a second accessory mounted to the mounting rail, wherein operation of the first accessory and the second accessory is coordinated through an electrical connection between at least a first electrical contact and a second electrical contact; and data acquired from the first accessory through the first electrical contact is communicated through the second electrical contact to the second accessory.

10. A firearm mounting rail assembly for engaging a firearm accessory, the mounting rail assembly comprising:

(a) a mounting rail body having a mounting rail for engaging a firearm accessory, the mounting rail having (i) an electrical input contact, (ii) a plurality of electrical output contacts spaced from the electrical input contact, (iii) an electronic control, and (iv) an embedded electrical conductor interconnecting the electrical input contact, the electronic control and the electrical output contacts, each of the electrical output contacts having a unique address with the electronic control.

11. The mounting rail assembly of claim 10, wherein the mounting rail body is integral with the firearm.

12. The mounting rail assembly of claim 10, wherein the mounting rail body includes a receptor channel for cooperatively engaging a firearm.

13. The firearm mounting rail assembly of claim 10, wherein the electronic control is one of a controller, a switch, a control circuit and a printed circuit board.

14. An accessory mounting rail assembly for a firearm, the mounting rail assembly comprising:

(a) a mounting rail body supporting an accessory that enhances functionality of the firearm;

(b) a receptor channel in the mounting rail body having receiving surfaces for receiving mating mounting surfaces of a mounting rail attached at least indirectly to the firearm;

(c) electrical contacts on at least one of receiving surfaces of the receptor channel; and (d) one of a controller, a control circuit and a printed circuit board within the mounting rail body.

15. The mounting rail assembly of claim 14, wherein one of the receiving surfaces of the receptor channel is movable relative to a remaining one of the receiving surfaces of the receptor channel.

16. The mounting rail assembly of claim 14, wherein one of the receiving surfaces of the receptor channel is fixed to the body, and the electrical contacts are formed on the fixed receiving surface.

* * * * *